US006000098A

United States Patent [19]

Klüting

[11] Patent Number: 6,000,098

[45] Date of Patent: Dec. 14, 1999

[54] DOOR LOCK FOR A MOTOR VEHICLE DOOR FORMED INTEGRALLY WITH THE DOOR HINGE

[75] Inventor: Bernd-Alfred Klüting, Radevormwald, Germany

[73] Assignee: ED Scharwächter GmbH, Remscheid, Germany

[21] Appl. No.: 09/104,679

[22] Filed: Jun. 25, 1998

[30] Foreign Application Priority Data

Jun. 25, 1997 [DE] Germany ..... 197 27 041

[51] Int. Cl.[6] ..... E05D 11/10

[52] U.S. Cl. ..... 16/334; 16/330; 16/322

[58] Field of Search ..... 16/334, 330, 328, 16/329, 331, 332, 352, 353, 312–314, 299, 300, 321, 322

[56] References Cited

U.S. PATENT DOCUMENTS

| | | | |
|---|---|---|---|
| 1,159,529 | 11/1915 | Parizek | 16/334 |
| 1,364,322 | 1/1921 | Rowan . | |
| 4,829,633 | 5/1989 | Kassner | 16/322 |
| 5,173,993 | 12/1992 | Baker | 16/329 |
| 5,878,463 | 3/1999 | Kluting et al. | 16/334 |

FOREIGN PATENT DOCUMENTS

| | | |
|---|---|---|
| 1020278 | 11/1957 | Germany . |
| 1813379 | 4/1960 | Germany . |
| 4212181 | 10/1993 | Germany . |

*Primary Examiner*—Chuck Y. Mah
*Attorney, Agent, or Firm*—Brown & Wood, LLP

[57] ABSTRACT

A door lock for a motor vehicle door formed integrally with a detachable door hinge and including a plurality of braking and locking bodies, a support for supporting the braking and locking bodies and connected with the hinge pin for joint rotation therewith, a locking device having at least partially curved running track concentrically arranged with respect to the hinge pin axis and fixedly connected with the one of the two hinge halves of the hinge, and a spring supported against the hinge pin and at least partially congruent with the locking device for biasing the support toward the locking device, with the support including a guide member for partially receiving the braking and locking bodies and connected with the hinge pin, the guide member having a central bore through which the hinge pin extends and a recess concentric with the hinge pin axis for receiving the biasing spring, and with the guide member being formed as a monolithic shaped body of a plastic material.

15 Claims, 2 Drawing Sheets

DOOR LOCK FOR A MOTOR VEHICLE DOOR FORMED INTEGRALLY WITH THE DOOR HINGE

BACKGROUND OF THE INVENTION

1. Field of the Invention

The present invention relates to a door lock for a motor vehicle door, which is formed integrally with a detachable door hinge having two hinge halves attached to respective two parts of a door assembly, a door and a door pillar, and connected with a hinge pin for rotation relative to each other with the hinge pin being received in one of the two hinge halves with a running fit and being connected with another of the two hinge halves for joint rotation therewith, with the door lock including a plurality of braking and locking bodies which are formed as rolling bodies, a support for supporting the bracking and locking bodies, the support being arranged concentrically with respect to a hinge axis and being connected with the hinge pin for joint rotation therewith, a plurality of axles extending transverse to the hinge pin axis for supporting the braking and locking bodies in the support, a locking device having a plurality of detent markings corresponding to the plurality of braking and locking bodies, the locking device having an at least partially curved running track concentrically arranged with respect to the hinge pin axis and fixedly connected with the one of the two hinge halves, the braking and locking bodies cooperating with the locking device for retaining the motor vehicle door in a predetermined position, and a spring element supported against the hinge pin and at least partially congruent with the locking device for biasing the support toward the locking device.

2. Description of the Prior Art

In door locks of the type described above, there is provided at least one braking and locking body which is formed as a rolling body rotatably supported on an axle extending transverse to the hinge pin axis. The braking and locking body is biased by a loading spring, which is supported at the free end of the hinge pin, into indentations which define detent markings of a running track. The indentations are provided on the end surface of the at least partially curved running track formed on a collar concentrically arranged with respect to the hinge pin axis. Generally, the braking and locking bodies are formed as conical rollers and are supported on a metal support engageable by the loading spring which simultaneously connects the support with the hinge pin for their joint rotation. In this type of a door lock, also the loading spring is connected with the hinge pin by a metallic support which is form-lockingly connected with support for the braking and locking bodies by end face toothing.

Such construction of the door lock permits, advantageously, to reduce the door lock dimensions which insures that less mounting space is needed for a hinge-lock assembly and insures a cost-effective manufacturing of the assembly. However, a drawback of this construction consists in that the loading spring which is associated with the support for the braking and locking bodies, is formed of a plate spring pack that applies a biasing force to a central region of the support which surrounds the hinge pin and that has a comparatively large weight. A relatively noiseless operation of such a door lock is possible only when the engageable with each other structural components are formed with minimal tolerances which results in relatively high manufacturing costs. Also, in case of unfavorable tolerance pairs, predetermined locking positions of the door cannot be adequately retained, and/or an insufficient braking and locking force is applied to the door.

Accordingly, an object of the present invention is to provide a door lock of the above-described type in which a predetermined position of the door is reliably retained.

Another object of the present invention is to provide a door lock of the above-described type which can be produced with the smallest possible manufacturing costs.

A further object of the present invention is to provide a door lock of the above-described type a noiseless operation of which is achieved independent of the tolerances.

SUMMARY OF THE INVENTION

These and other objects of the present invention, which will become apparent hereinafter, are achieved by providing a door lock of the above-described type in which the support includes a guide member for partially receiving the braking and locking bodies and connected with the hinge pin, with the guide member having a central bore through which the hinge pin extends and a recess concentric with the hinge pin axis for receiving the biasing spring means, and with the guide member being formed as a monolithic shaped body of a plastic material.

Together with the advantage resulting from a direct connection in a circumferential direction of the braking and locking bodies with the hinge pin, which consists in that less mounting space is needed for the hinge-door lock assembly, providing of a drive member formed as a plastic monolithically shaped member insures, on one hand, a relatively simple manufacturing and assembly and, on the other hand, a noise-free operation of the door lock, independent on occurring tolerances of the components. Further, the use of a plastic material insures a high adaptability of the shape of the loading spring-receiving recess to the shape of the spring, in particular, when the spring is formed as a helical spring. The use of the plastic material further results in a reduction of the door lock weight.

According to a preferred embodiment of the invention, there is provided a coupling member formed of a plastic material and form-lockingly connected with the hinge pin and having a radially extending circumferential toothing which cooperates with the inner toothing of the guide member and forms with the inner toothing a claw coupling which connects the guide member with the hinge pin insuring their joint rotation. In order to insure a reliable connection of the preferably disc-shaped coupling member with the hinge pin and to provide a sufficient engagement length of the coupling member with the hinge pin, the coupling member is provided with a downwardly extending, necklike axial attachment having an inner circumferential toothing cooperating with a outer toothing provided on the hinge pin for connecting the coupling member with the hinge pin, and the door lock further comprises means for preventing an axial displacement of the coupling member.

Providing the disc-shaped coupling member with a neck-shaped attachment permits to arrange inside the lock a safety element, e.g., a clip ring which prevents an axial displacement of the coupling member relative to the hinge pin, which permits to reduce the overall length of the lock.

In order to insure a wear-free arrangement of the braking and locking bodies, according to the invention, the hinge pin-receiving bore of the guide member is provided with a sleeve-shaped lining which provides for an axial displacement of the guide body along the hinge pin.

A wear-free stable positioning of the braking and locking bodies on the guide member, independent of properties or quality of the material from which the guide member is formed, is achieved by providing a metallic support disc for supporting the braking and locking bodies and received in an end portion of the guide member adjacent to the hinge, with the support disc having a central opening through which the hinge pin extends and peripheral openings for receiving the braking and locking bodies which are formed as conical rollers.

This permit to protect the guide member from high local loads which, on one hand, permits to select a soft and, therefore, noise damping material for the guide body and, on the other hand enables a long-lasting, tolerance-free support of the conical roller-shaped braking and locking bodies.

According to a further development of the present invention, the support disc is formed of a sheet material and has a shape of a cross with bearing shell-forming stamped sections in which the supporting axles are received, with an axle of each roller being associated with two stamped sections spaced by a distance corresponding to a width of a conical roller forming a braking and locking member.

To further increase the durability of the door lock, it is further contemplated, in accordance with an advantageous embodiment of the present invention, to provide stop washers concentric with respective supporting axles on opposite sides of each conical roller.

Apart from equipping the guide member with a support disc for supporting the axles of the braking and locking bodies, naturally, mounting of the braking and locking bodies directly on the guide member is possible. In the latter case, the guide member is provided, at its end adjacent to the hinge, with axially extending recesses for receiving the supporting axles of the braking and locking bodies. The braking and locking bodies, in this case, are rotatably supported by axle journals for rotation about axis extending transverse to the hinge pin axis. The braking and locking bodies are located in bearing lugs forming extensions of a bottom portion of the guide member.

Instead of providing a support disc for supporting the braking and locking bodies, according to a further development of the present invention, the braking and locking bodies are located in respective U-shaped cages receivable in respective axial cavities formed in the guide member. Each cage is formed as a sheet metal stamping, with respective axles extending through both legs of respective cages and being secured to respective inner legs of the respective cages in an axial direction with rivets.

According to a still further development of the present invention, the loading spring is formed as a diaphragm spring provided with a circumferential toothing which cooperates with an inner circumferential toothing of the guide member for connecting the guide member with the hinge pin for joint rotation therewith. Providing a component which functions both as a loading spring and a coupling member permits to substantially reduce the dimensions of a door lock.

The loading spring can also be formed as a plate spring having an outer circumferential toothing engageable with an inner circumferential toothing of the guide member for connecting the guide member with the hinge pin for joint rotation therewith, with the plate spring being form-lockingly connected with the hinge pin.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
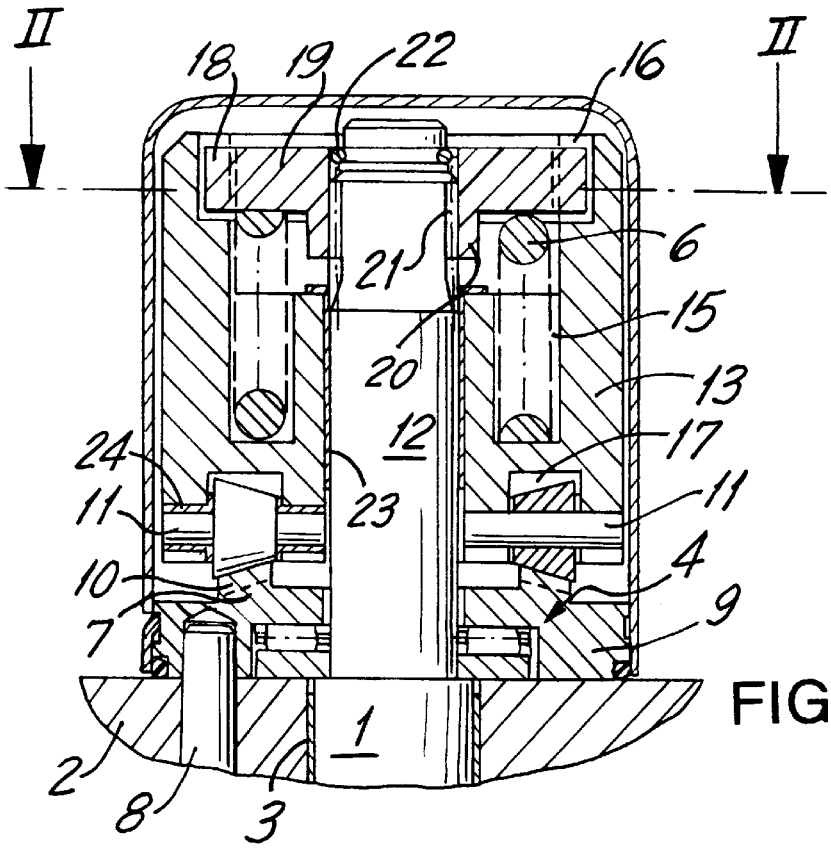
FIG. 1 shows a longitudinal cross-sectional view of a door lock according to the present invention and formed integrally with a separable door hinge for a motor vehicle door.

A separable door hinge for a motor vehicle door, shown in the drawings, includes a first hinge half 2 and a second hinge half, which are connected, respectively, to first and second parts of a door assembly, not shown in the drawings, and a hinge pin 1 which connects the first and second hinge halves for their pivotal movement relative to each other. The hinge pin 1 is rotatably supported in the first hinge half 2 by a bearing sleeve 3 of a maintenance-free bearing material with a running fit. A door lock, which is formed integrally with the separable or detachable hinge, includes a locking device 4, braking and locking bodies 5, a guide member 13 connectable with the first hinge half 2, and a spring 6 for biasing the braking and locking bodies.

In the embodiment of the door lock shown in FIGS. 1–4, the locking device is formed by a running track 10. The running track 10 is arranged on the end surface of a projecting collar 7 of a locking disc 9 which is fixedly connected with the first hinge half 2 by cylindrical pins 8 concentric with respect to the axis of the hinge pin 1. The running track 10, which forms the locking device, is inclined, as particularly shown in FIG. 1, outwardly toward the circumference of the locking disc 9. The braking an d locking bodies are formed as conical rollers the shape of which correspond to the inclination of the running track 10. The braking and locking bodies 5 are supported on respective axles 11 which extend transverse to the hinge axis 12 and are rotatably supported on the guide member 13. The guide member 13 is formed as a monolithic shape body of a plastic material. The guide member 13 has a central bore 14 for receiving the hinge pin 1 therein. The guide member 13 has an annular recess which forms an annular space 15 concentric with the hinge 1 for receiving the helical spring 6. The helical spring 6 is likewise concentrically arranged with respect to the hinge pin and is supported against the hinge pin 1. The guide member 13 is provided, at one of its ends, with an internal circumferential toothing 16 for attachment to the hinge pin 1 for joint rotation therewith at its opposite end, the guide member 13 is formed as a carrier for the braking and locking bodies 5 and has, at this end, axially extending openings 17 in which the braking and locking bodies are partially received.

The monolithic guide member 13 is connected with the hinge pin 1 by a disc-shaped coupling member 19, which likewise is formed of a plastic material, is form-lockingly connected with the hinge pin 1 and is provided with radially extending circumferential toothing 18. The internal toothing 16 of the guide member 16 and the circumferential toothing 18 of the coupling member 19 form together a claw-coupling. The coupling member 19 is connected with the hinge pin 1 for joint rotation therewith by a mutual inner-outer circumferential toothing 21. the coupling member 19 has a collar-like axial projection 20 extending inward with respect to the guide member 13. An inwardly located holding member 22 prevent an axial displacement of the coupling member 19 relative to the hinge pin 1. The guide member 13 is supported with a possibility of an axial displacement along the pin 1 by a sleeve 23 which is located in the central bore of the guide member 13. The sleeve 23 insures a wear-free displacement of the guide member 13 along the hinge pin 1.

Figure 3:
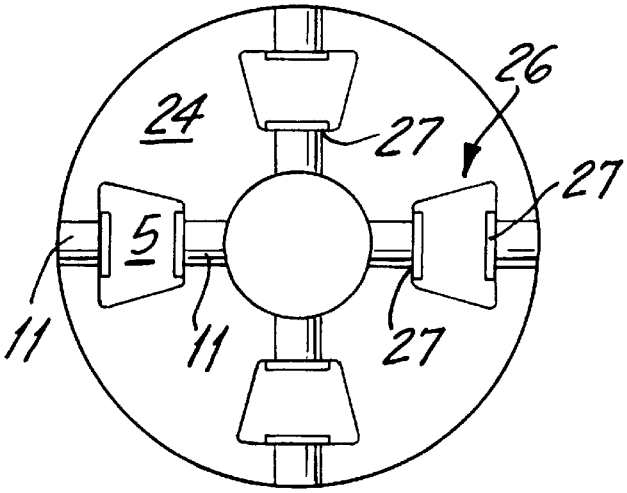
FIG. 3 shows a plan view of a support disc for the braking and locking body of the door lock shown in FIG. 1.
Figure 4:
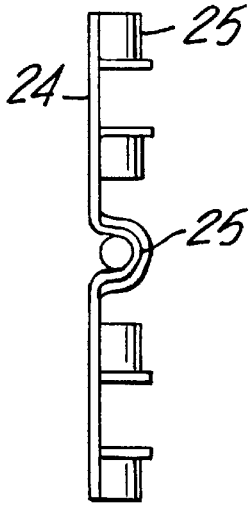
FIG. 4 shows a side view of the support disc shown in FIG. 1.

As shown in FIGS. 3 and 4, the braking and locking bodies 5, which are formed as conical rollers, are supported on the guide member 13 by a metallic support disc 24 secured in an end region of the guide member 13 adjacent to the hinge half 2. The support disc 24 has a central through-opening 25 for accommodating the hinge pin 1 and circumferentially located openings 26 for the conical roller-shaped braking and locking bodies 5. The support disc 24 is formed of a sheet metal and has in the embodiment shown in the drawing, a shape of a cross in the plan view. The support disc has four bearing-shell forming stamping 25 for supporting the axles 11 of braking and locking bodies 5 which are formed, as discussed above, as conical rollers. The axle 11 of each braking and locking body 5 is associated with two stampings 25 spaced from each other by a distance corresponding to the width of a conical roller. On opposite sides of each braking and locking body, which is formed as a conical roller, there are provided two stop washers 27 concentric with a respective axle 2.

Figure 5:
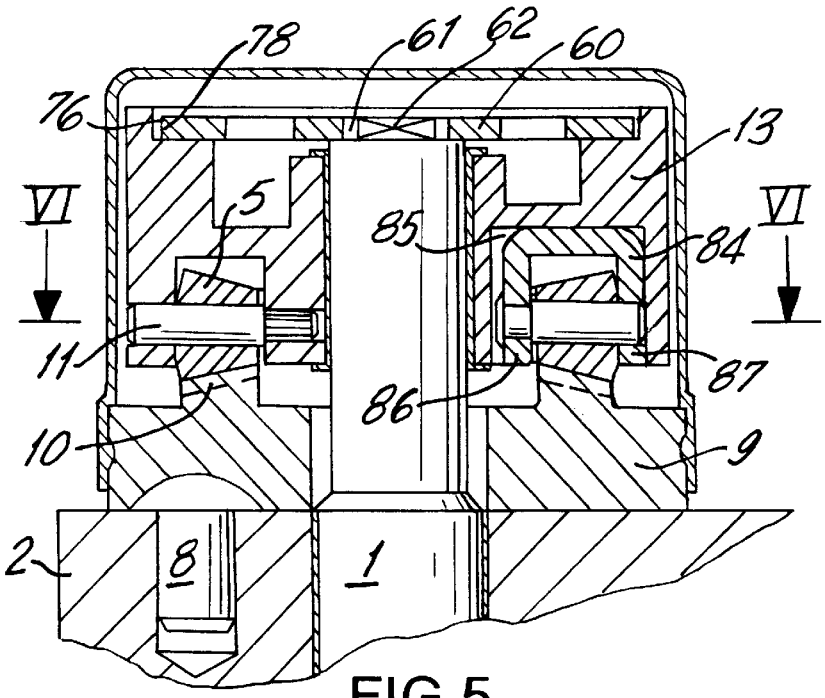
FIG. 5 shows a longitudinal cross-sectional view of another embodiment of a door lock according to the present invention and formed integrally with a separable door hinge for a motor vehicle door.
Figure 2:
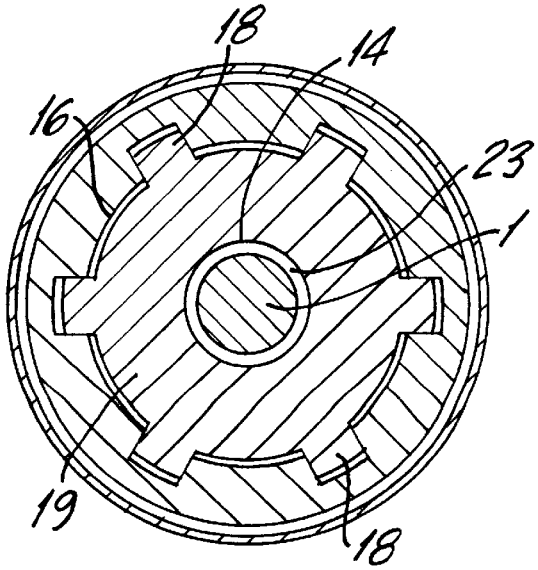
FIG. 2 shows a cross-sectional view along line II—II of the door lock shown in FIG. 1.
Figure 6:
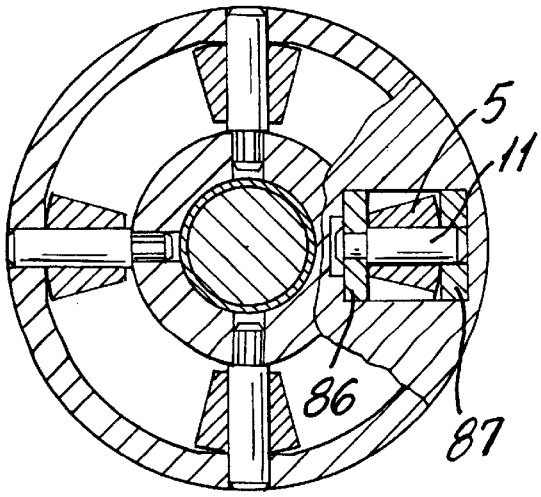
FIG. 6 shows a cross-sectional view along line VI—VI of the door lock shown in FIG. 5.

FIG. 5 shows an extremely small construction of a door lock according to the present invention. In this embodiment, with the locking device having a conventional construction, the loading spring, which is formed as a diaphragm spring 60, is provided with circumferential toothing 78 which cooperates with inner circumferential toothing 76 of the guide member 13. The diaphragm spring 60 is connected with the hinge pin 1 for joint rotation therewith. To this end, the diaphragm spring 60 has a central square opening 61 into which a likewise square-shaped end portion 62 of the hinge pin 1 extends. The braking and locking bodies 5 are supported bag respective axles 11 in a U-shaped cage 84 provided with respective axial cavities 85. Each axle 11 ends through opposite legs 86, 87 of the U-shaped cage 84 and secured to the inner leg 86 with a rivet.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope the appended claims.

What is claimed is:

1. A door lock for a motor vehicle door, which is formed integrally with a detachable door hinge having two hinge halves attached to respective two parts of a door assembly, a door and a door pillar, and connected with a hinge pin for rotation relative to each other, with the hinge pin being received in one of the two hinge halves with a running fit and being connected with another of the two hinge halves for joint rotation therein, the door lock comprising:

a plurality of braking and locking bodies which are formed as rolling bodies;

support means for supporting the braking and locking bodies, the support means being arranged concentrically with respect to a hinge pin axis and being connected with the hinge pin for joint rotation therewith;

plurality of axles extending transverse to the hinge pin axis for supporting the braking and locking bodies in the support means:

a locking device having a plurality of detent markings corresponding to the plurality of braking and locking bodies, the locking device having an at least partially curved running track concentrically arranged with respect to the hinge pin axis and fixedly connected with the one of the two hinge halves, the braking and locking bodies cooperating with the locking device for retaining the motor vehicle door in a predetermined position; and spring means supported against the hinge pin and at least partially congruent with the locking device for biasing the support means toward the locking device, wherein the support means comprises a guide member for partially receiving the braking and locking bodies and connected with the hinge pin, the guide member having a central bore through which the hinge pin extends and a recess concentric with the hinge pin axis for receiving the biasing spring means, and wherein the guide member is formed as a monolithic shaped body of a plastic material, and wherein the door lock further comprises a coupling member formed of a plastic material and form-locking connected with the hinge pin, the coupling member having a radially extending circumferential toothing cooperating with an inner circumferential toothing of the guide member and forming with the inner toothing a claw coupling for connecting the guide member with the hinge pin for joint rotation for joint rotation of the guide member with the hinge pin.

2. A door lock as set forth in claim 1, wherein the coupling member has a downwardly extending, necklike axial attachment having an inner circumferential toothing cooperating with an outer toothing provided on the hinge pin for connecting the coupling member with the hinge pin, and wherein the door lock further comprises means for preventing an axial displacement of the coupling member.

3. A door lock as set forth in claim 1, wherein the spring means comprises a helical spring received in the recess provided in the guide member.

4. A door lock as set forth in claim 1, wherein the central bore of the guide member is provided with a sleeve-shaped lining for enabling an axial displacement of the guide member along the hinge pin.

5. A door lock as set forth in claim 1, wherein the support means comprises a metallic support disc for supporting the braking and locking bodies and received in an end portion of the guide member adjacent to the hinge, the support disc having a central opening through which the hinge pin extends and peripheral openings for receiving the braking and locking bodies which are formed as conical rollers.

6. A door lock as set forth in claim 5, wherein the support disc is formed of a sheet material and has a shape of a cross with bearing sheel-forming stamped sections in which the supporting axles are received.

7. A door lock as set forth in claim 6, wherein an axle of each roller is associated with two stamped sections spaced by a distance corresponding to a width of a conical roller which forms a braking and locking member.

8. A door lock as set forth in claim 7, wherein stope washers concentrically arranged on the respective axles are located on opposite sides of respective rollers.

9. A door lock as set forth in claim 1, wherein the braking and locking bodies, which are formed as conical rollers are located in bearing lugs forming extensions of the guide member.

10. A door lock as set forth in claim 1, wherein the spring means comprises a diaphragm spring having a circumferential toothing engageable with an inner circumferential toothing provided on the guide member for connecting the guide member with the hinge pin for joint rotation therewith.

11. A door lock as set forth in claim 10, wherein the diaphragm spring is form-lockingly connected with the hinge pin.

12. A door lock as set forth in claim 1, wherein the spring means comprises a plate spring having an outer circumferential toothing engageable with an inner circumferential toothing of the guide member for connecting the guide member with the hinge pin for joint rotation therewith.

13. A door lock as set forth in claim 12, wherein the plate spring is form-lockingly connected with the hinge pin.

14. A door lock as set forth in claim 1, wherein the braking and locking bodies are located in respective U-shaped cages receivable in respective axial cavities formed in the guide member.

15. A door lock as set forth in claim 14, wherein a cage is formed as a sheet metal stamping, and wherein respective axles extend through both legs of respective cages and are secured to respective inner legs of the respective cages in an axial direction with rivet means.

* * * * *